US008336983B2

(12) United States Patent
Chikamoto

(10) Patent No.: US 8,336,983 B2
(45) Date of Patent: Dec. 25, 2012

(54) INK-JET RECORDING APPARATUS FOR DEALING WITH JAMS OF RECORDING MEDIA

(75) Inventor: Tadanobu Chikamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 239 days.

(21) Appl. No.: 12/635,659

(22) Filed: Dec. 10, 2009

(65) Prior Publication Data

US 2010/0156984 A1 Jun. 24, 2010

(30) Foreign Application Priority Data

Dec. 22, 2008 (JP) ..... 2008-325960

(51) Int. Cl.
*B41J 29/38* (2006.01)

(52) U.S. Cl. ..... 347/16

(58) Field of Classification Search ..... 347/16, 347/104; 346/134; 399/21
See application file for complete search history.

(56) References Cited

U.S. PATENT DOCUMENTS

| | | | | |
|---|---|---|---|---|
| 4,887,101 | A * | 12/1989 | Hirose et al. | 346/134 |
| 2003/0156298 | A1 | 8/2003 | Matsuyama et al. | |
| 2004/0234280 | A1 | 11/2004 | Matsuyama et al. | |
| 2005/0212883 | A1 | 9/2005 | Okamoto | |
| 2007/0035605 | A1* | 2/2007 | Kitahara | 347/104 |
| 2008/0095546 | A1 | 4/2008 | Abe | |
| 2008/0239051 | A1* | 10/2008 | Kato | 347/104 |
| 2009/0169222 | A1* | 7/2009 | Watanabe | 399/21 |
| 2010/0156983 | A1* | 6/2010 | Tamaki | 347/16 |

FOREIGN PATENT DOCUMENTS

| | | | |
|---|---|---|---|
| JP | H11-084783 | A | 3/1999 |
| JP | 2002-255442 | A | 9/2002 |
| JP | 2003-307981 | A | 10/2003 |
| JP | 2004-074611 | A | 3/2004 |
| JP | 2005-035082 | A | 2/2005 |
| JP | 2005-111939 | A | 4/2005 |
| JP | 2005-131929 | A | 5/2005 |

(Continued)

OTHER PUBLICATIONS

Japan Patent Office, Notification of Reasons for Refusal for Japanese Patent Application No. 2008-325960, dispatched Dec. 7, 2010.
Japan Patent Office, Decision of Refusal for Japanese Patent Application No. 2008-325960, dispatched Mar. 1, 2011.

(Continued)

*Primary Examiner* — Stephen Meier
*Assistant Examiner* — Carlos A Martinez
(74) *Attorney, Agent, or Firm* — Baker Botts L.L.P.

(57) ABSTRACT

An ink-jet recording apparatus, including: an ink-jet head; a conveyor mechanism; a sensor to detect a recording medium being conveyed; a detecting device; an output device; and a controller to control the relative movement mechanism to conduct a first operation in which the conveyor mechanism and the ink-jet head are located at a medium removal position from a recording position, when the detecting device detects a jam, to control the conveyor mechanism to conduct a second operation in which an unremoved jammed recording medium which has not been removed by the user is conveyed so as to be detectable by the sensor, when the output device outputs a jam-clearing completion signal, and to control the relative movement mechanism to conduct a third operation in which the conveyor mechanism and the head are located at the recording position from the medium removal position after the second operation.

19 Claims, 6 Drawing Sheets

FOREIGN PATENT DOCUMENTS

| | | | |
|---|---|---|---|
| JP | 2005-271278 | A | 10/2005 |
| JP | 2007-137618 | A | 6/2007 |
| JP | 2007-283644 | A | 11/2007 |
| JP | 2008-107418 | A | 5/2008 |
| WO | 2006/054665 | A1 | 5/2006 |

OTHER PUBLICATIONS

Japan Patent Office, Decision to Grant a Patent for Japanese Patent Application No. 2011-123106 (counterpart Japanese patent application), dispatched Oct. 23, 2012.

* cited by examiner

INK-JET RECORDING APPARATUS FOR DEALING WITH JAMS OF RECORDING MEDIA

CROSS REFERENCE TO RELATED APPLICATION

The present application claims priority from Japanese Patent Application No. 2008-325960, which was filed on Dec. 22, 2008, the disclosure of which is herein incorporated by reference in its entirety.

BACKGROUND OF THE INVENTION

1. Field of the Invention

The present invention relates to an ink-jet recording apparatus configured to record an image on a recording medium.

2. Discussion of Related Art

There is known an image forming apparatus having a plurality of ink heads, a platen portion (a conveyor mechanism) configured to convey a recording medium so as to be opposed to the ink heads, and a platen moving portion configured to move the platen portion upward and downward. The platen moving portion is capable of moving the platen portion between an image forming position and a jam-clearing position. In an instance where a jam of the recording medium occurs between the ink-heads and the platen portion, the platen portion is moved by the platen moving portion to the jam-clearing position, allowing a user to remove the jammed recording medium.

SUMMARY OF THE INVENTION

According to the arrangement described above, whether a jam-clearing processing for removing a jammed recording medium is conducted or not is up to a user, so that there may be an instance in which the user forgets about removing the jammed recording medium and an instance in which a part of the jammed recording medium remains in the apparatus without being completely removed. Where the platen portion is moved from the jam-clearing position to the image forming position, namely, where the platen portion is moved toward the ink-heads, with the jammed recording medium remaining in the apparatus, the remaining recording medium may come into contact with ink ejection surfaces of the ink heads, causing a risk of damaging the ejection surfaces and nozzles formed in the ejection surfaces.

It is therefore an object of the invention to provide an ink-jet recording apparatus which can prevent a jammed recording medium from remaining between an ejection surface and a conveyor mechanism and which can protect the ejection surface from being damaged.

The above-indicated object may be attained according to a principle of the invention, which provides an ink-jet recording apparatus, comprising:

an ink-jet head in which is formed an ejection surface from which ink is ejected;

a conveyor mechanism which is configured to convey a recording medium on a conveyor surface in a medium conveyance direction, so as to be opposed to the ejection surface;

a sensor configured to detect, at a prescribed position, the recording medium being conveyed on the conveyor surface by the conveyor mechanism;

a relative movement mechanism configured to move at least one of the conveyor mechanism and the ink-jet head relative to each other such that the conveyor mechanism and the ink-jet head are located selectively at one of: a recording position at which an image is recorded on the recording medium with the ink ejected from the ink-jet head; and a medium removal position at which a distance between the ejection surface and the conveyor mechanism is larger than that when the conveyor mechanism and the ink-jet head are located at the recording position and at which a jammed recording medium which is jammed between the ejection surface and the conveyor mechanism is allowed to be removed by a user;

a detecting device configured to detect an occurrence of a jam of the recording medium between the ejection surface and the conveyor mechanism;

an output device configured to output a jam-clearing completion signal indicative of completion of a jam-clearing processing for clearing the jam of the recording medium, in response to a prescribed operation by the user; and a controller configured to control the relative movement mechanism to conduct a first operation in which the at least one of the conveyor mechanism and the ink-jet head is moved relative to each other such that the conveyor mechanism and the ink-jet head are located at the medium removal position from the recording position, when the detecting device detects the occurrence of the jam of the recording medium, to control the conveyor mechanism to conduct a second operation in which an unremoved jammed recording medium which has not been removed by the user is conveyed so as to be detectable by the sensor, when the output device outputs the jam-clearing completion signal, and to control the relative movement mechanism to conduct a third operation in which the at least one of the conveyor mechanism and the ink-jet head is moved relative to each other such that the conveyor mechanism and the ink-jet head are located at the recording position from the medium removal position after the second operation.

It is noted that "to move at least one of the conveyor mechanism and the ink-jet head" means that only one of the ink-jet head and the conveyor mechanism is moved by the relative movement mechanism or both of the ink-jet head and the conveyor mechanism are moved relative to each other by the relative movement mechanism. It is further noted that each of the recording position and the medium removal position corresponds to relative positions of the ink-jet head and the conveyor mechanism.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE PREFERRED EMBODIMENT

There will be hereinafter described a preferred embodiment of the invention with reference to the drawings.

Figure 1:
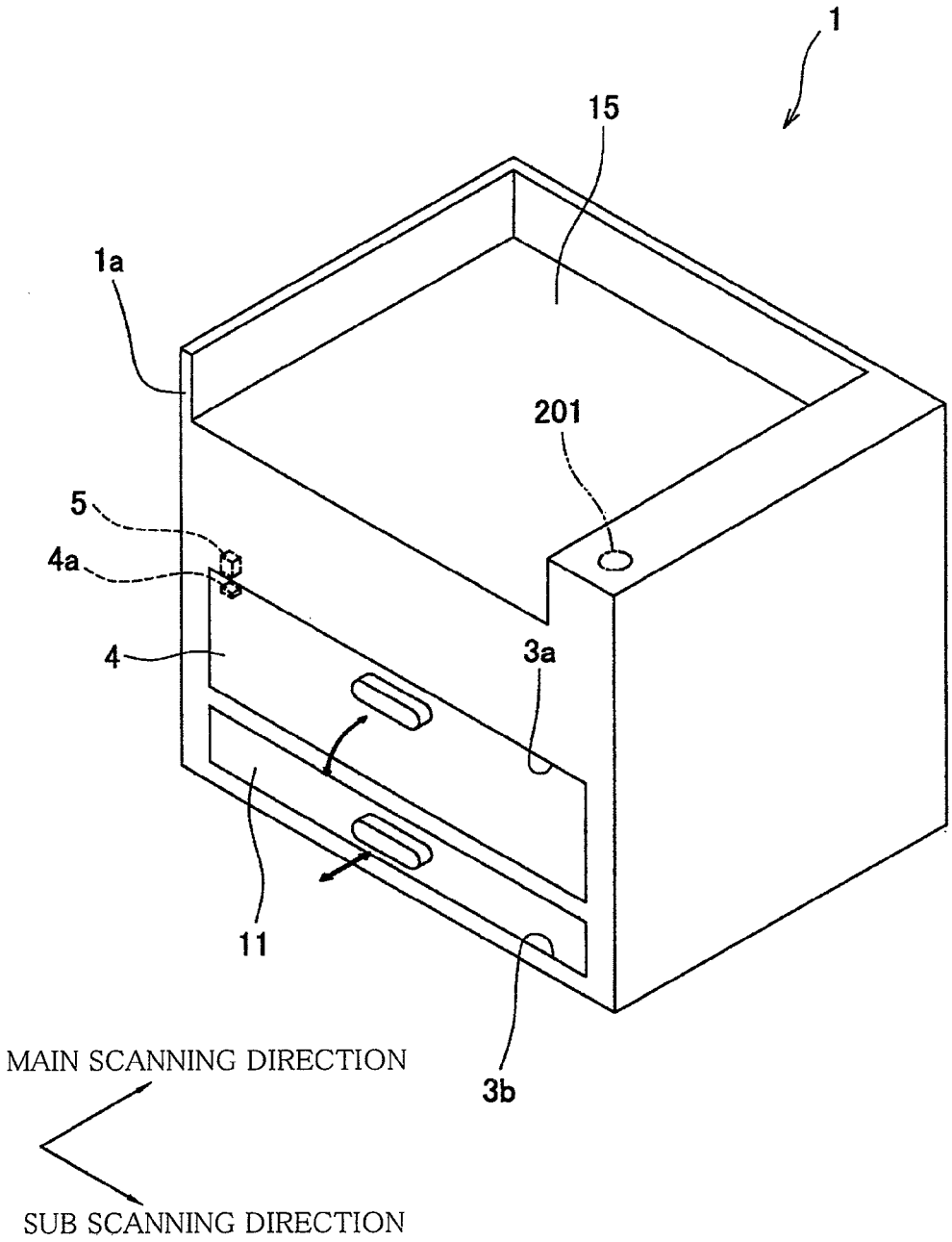
FIG. 1 is a perspective external view of an ink-jet printer according to one embodiment of the invention.

As shown in the perspective view of FIG. 1, an ink-jet printer 1 as an ink-jet recording apparatus has a casing 1*a* which is a rectangular parallelepiped and which has two openings, i.e., upper and lower openings 3*a*, 3*b*, that are formed on the front of the casing 1*a* (on the front surface of the casing 1*a* in FIG. 1). In the opening 3*a*, a door 4 is provided so as to be openable and closable about a horizontal axis located at the lower end of the opening 3*a*. The opening 3*a* and the door 4 are disposed so as to be opposed to a belt conveyor device 50 in a depth direction of the casing 1, namely, in a direction perpendicular to the plane of FIG. 2, i.e., in a main scanning direction. That is, the opening 3*a* and the door 4 are disposed such that a sheet P jammed between ink-jet heads 2 and the belt conveyor mechanism 50 is exposed to an exterior of the casing 1*a* through the opening 3*a* when the door 4 is opened. At the corner portion of the inner surface of the door 4, a projection 4*a* is provided. A sensor 5 is provided in the casing 1*a*. The sensor 5 is configured to detect the projection 4*a* when the door 4 that has been opened is closed.

Figure 2:
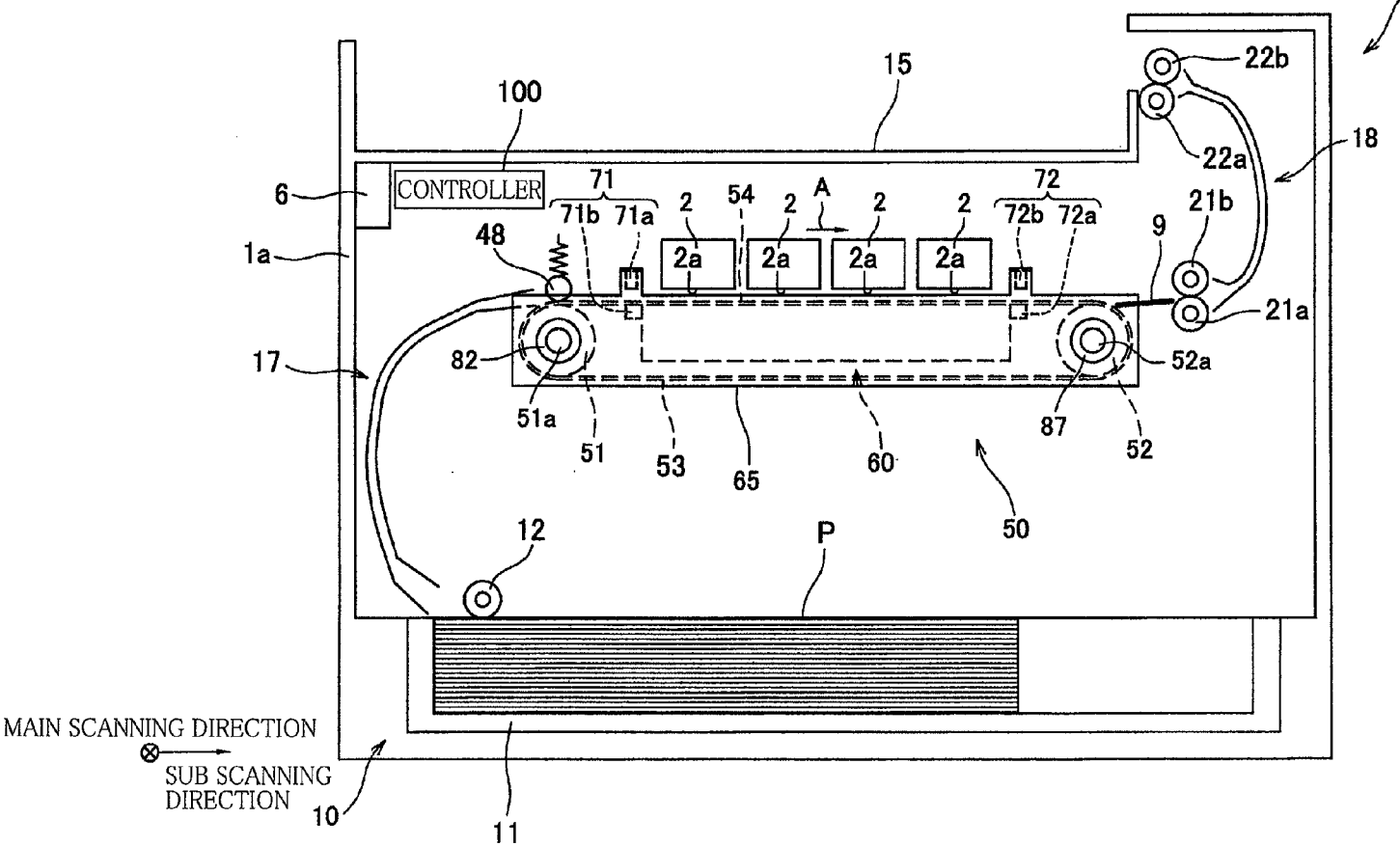
FIG. 2 is a schematic side view showing an internal structure of the ink-jet printer of FIG. 1.

As shown in FIG. 2, the ink-jet printer 1 is a color ink-jet printer having four ink-jet heads 2 which respectively eject inks of different colors, i.e., magenta, cyan, yellow, and black. The ink-jet printer 1 has a sheet supply device 10 at its lower portion and a discharged-sheet receiving portion 15 at its upper portion. The belt conveyor device 50 for conveying the sheet P (as a recording medium) in a sheet conveyance direction A (as a medium conveyance direction) is disposed between the sheet supply device 10 and the discharged-sheet receiving portion 15. The ink-jet printer 1 further has a controller 100 for controlling operations thereof.

Each of the four ink-jet heads 2 has a generally rectangular parallelepiped shape that is long in the main scanning direction. The four ink-jet heads 2 are disposed along a sub scanning direction perpendicular to the main scanning direction. That is, the ink-jet printer 1 is a line-type printer. In the present embodiment, the sub scanning direction is a direction parallel to the sheet conveyance direction A while the main scanning direction is a direction perpendicular to the sub scanning direction and is horizontal.

Each ink-jet head 2 has a laminar body having: a flow-passage unit in which are formed ink passages that include pressure chambers; and an actuator for giving pressure to ink in the pressure chambers. The flow-passage unit and the actuator (both not shown) are bonded to each other so as to provide the laminar body. The bottom surface of each ink-jet head 2 is formed as an ejection surface 2*a* from which the ink is ejected.

As shown in FIG. 2, the sheet supply device 10 includes a sheet cassette 11 in which a stack of sheets P can be accommodated, a sheet supply roller 12 configured to supply an uppermost one of the sheets P from the sheet cassette 11, and a sheet supply motor 13 (FIG. 5) configured to rotate the sheet supply roller 12. The sheet cassette 11 is disposed so as to be attachable to and detachable from the casing 1*a* through the opening 3*b* in the main scanning direction. In a state in which the sheet cassette 11 is installed on the casing 1*a*, the sheet cassette 11 overlaps the belt conveyor device 50 when viewed from the top of the printer 1.

The sheet supply roller 12 is configured to supply the uppermost one of the sheets P from the sheet cassette 11 while being held in rolling contact therewith. The sheet supply motor 13 configured to rotate the sheet supply roller 12 is controlled by the controller 100. On a left-end side of the sheet cassette 11 as seen in FIG. 2, there is disposed a sheet guide 17 which extends in a curved form from the sheet cassette 11 toward the belt conveyor device 50.

In the structure described above, the sheet supply roller 12 is rotated clockwise in FIG. 2 by being controlled by the controller 100, whereby the sheet P contacting the sheet supply roller 12 is transferred to the belt conveyor device 50 through the sheet guide 17.

Figure 3A:
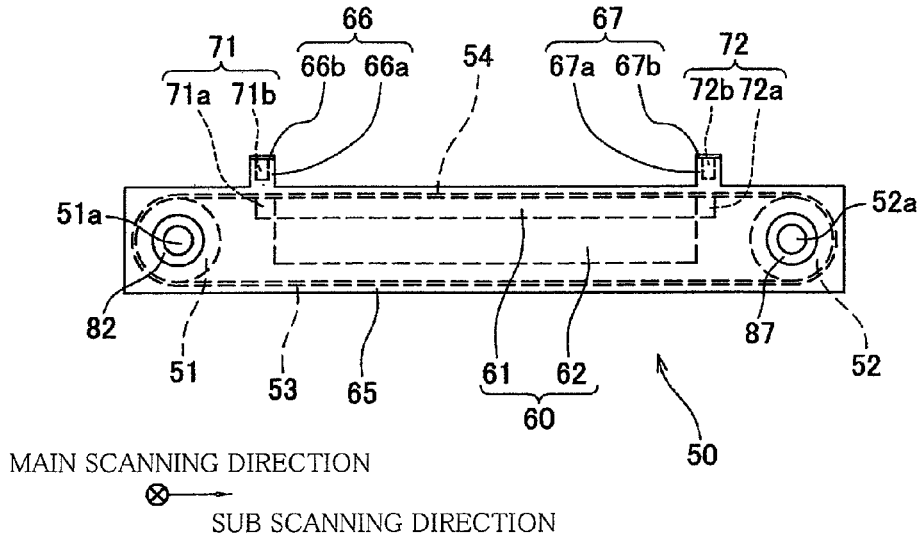
FIG. 3A is a side view of a belt conveyor device shown in FIG. 2
Figure 3B:
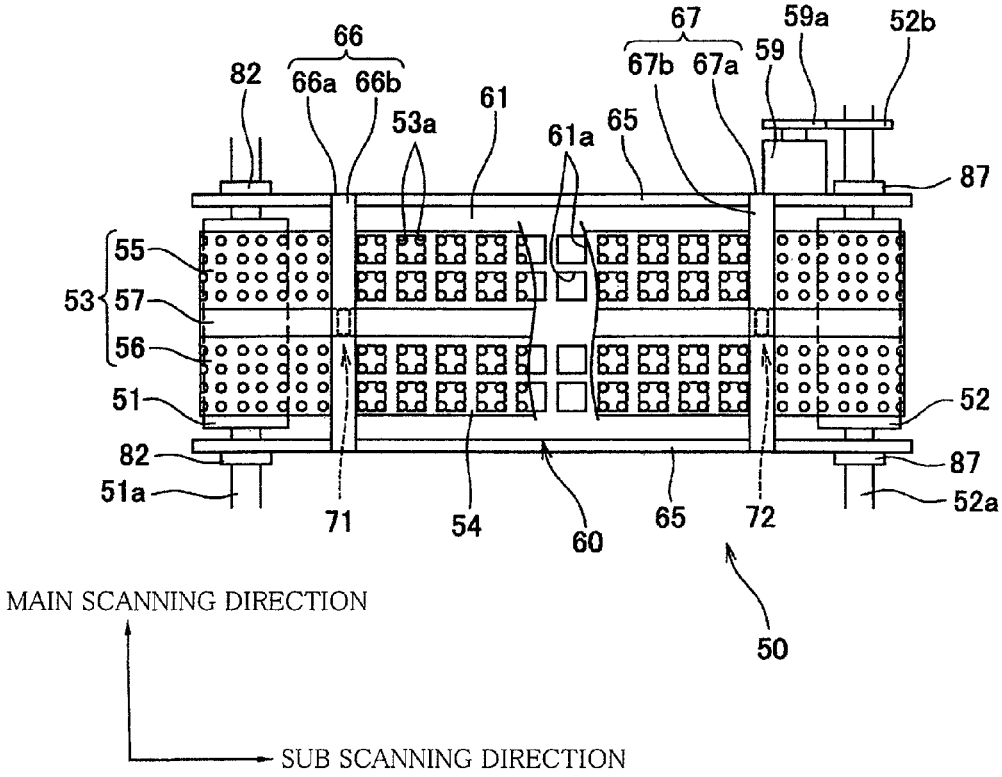
FIG. 3B is a plan view of the belt conveyor device.

As shown in FIGS. 3A and 3B, the belt conveyor device 50 includes two belt rollers 51, 52, an endless conveyor belt 53 wound around the two belt rollers 51, 52 so as to be stretched therebetween, a conveyance motor 59 configured to rotate the belt roller 52, an adhesion device 60. The two belt rollers 51, 52 are disposed along the sub scanning direction (the sheet conveyance direction A).

As shown in FIGS. 3A and 3B, the conveyor belt 53 has: two belt members 55, 56 having substantially the same width as measured in the main scanning direction; and an intermediate belt member 57 formed of a transparent material and interposed between the two belt members 55, 56. In other words, a light transmitting region provided by the belt member 57 is formed at a portion of a conveyor surface 54 (an outer circumferential surface) of the conveyor belt 53 on which the sheet P is supported, the portion being opposed to a middle portion of each ejection surface 2*a* in the main scanning direction. The conveyor surface 54 has a plurality of through-holes 53*a* formed through the thickness of the conveyor belt 53. The through-holes 53*a* are disposed so as to be distributed over the entirety of each of the two belt members 55, 56.

The two belt rollers 51, 52 are rotatably supported by a pair of support frames 65 having a plate-like configuration shown in FIGS. 3A and 3B. The support frames 65 are disposed so as to be opposed to each other in the main scanning direction with the two belt rollers 51, 52 whose axes extend in the main scanning direction interposed between the support frames 65. A conveyance motor 59 is fixed to the outer side surface of one of the support frames 65, namely, the upper one of the support frames 65 as seen in FIG. 3B. A gear 52*b* is fixed to a roller shaft 52*a* of the belt roller 52 so as to mesh with a gear 59*a* fixed to a drive shaft of the conveyance motor 59. That is, the belt roller 52 is configured to be rotated by the conveyance motor 59 being driven.

As shown in FIGS. 3A and 3B, two connecting members 66, 67 are fixed to the upper portions of the respective support frames 65 so as to connect the two support frames 65. Each connecting member 66, 67 has an inverted U shape when viewed from the left side toward the right-side in FIGS. 3A and 3B, i.e., when viewed from the upstream side toward the downstream side in the sub scanning direction. More specifically, the connecting member 66 has two vertical portions 66*a* extending upward from the upper portions of the respective two support frames 65 and a horizontal portion 66*b* connecting the upper ends of the respective two vertical portions 66*a*. Similarly, the connecting member 67 has two vertical portions 67*a* extending upward from the upper portions of the respective two support frames 65 and a horizontal portion 67*b* connecting the upper ends of the respective two vertical portions 67*a*. The two connecting members 66, 67 are disposed so as to be opposed to each other in the sheet conveyance direction A (the sub scanning direction) with the four ink-jet heads 2 interposed therebetween. That is, the connecting member 66 is disposed upstream of the four ink-jet heads 2 in the sheet conveyance direction A while the connecting member 67 is disposed downstream of the four ink-jet heads 2 in the sheet conveyance direction A.

The adhesion device 60 is disposed in a region enclosed by the conveyor belt 53 as shown in FIG. 3A and includes a platen 61 having a rectangular parallelepiped shape and a fan 62 disposed below the platen 61. The platen 61 and the fan 62 are fixed at opposite ends thereof in the main scanning direction to the inner side surfaces of the respective support frames 65. As shown in FIG. 3B, the platen 61 has, on its upper surface, a plurality of through-holes 61*a* formed through the thickness thereof. The through-holes 61*a* are disposed so as to be distributed over the entirety of two regions of the upper surface that are opposed to the respective two belt members 55, 56. Each through-hole 61*a* has a size that enables four through-holes 53*a* of the conveyor belt 53 to be accommodated in one through-hole 61*a* of the platen 61. The platen 61 has a dimension as measured in the main scanning direction slightly larger than dimensions of the sheet P and the conveyor belt 53 as measured in the same direction.

As shown in FIG. 3A, the upper surface of the platen 61 is held in contact with the inner circumferential surface of the conveyor belt 53 at the upper portion of the loop of the belt 53 so as to support the belt 53 from the inside of the loop. According to the arrangement, the conveyor belt 53 at the upper portion of the loop and the ejection surfaces 2*a* of the ink-jet heads 2 are opposed to each other so as to be parallel to each other, and there is formed a slight clearance therebetween. The clearance partially constitutes a sheet transfer path through which the sheet P is transferred.

The fan 62 has a generally rectangular parallelepiped shape shown in FIG. 3A. The fan is configured to suck in the air through suction ports (not shown) formed in its upper surface by rotation of rotary vanes provided in its inside. The fan 62 is controlled by the controller 100.

The belt conveyor device 50 is provided with two sensors 71, 72 at respective locations in the sheet conveyance direction A so as to sandwich the four ink-jet heads 2 therebetween. The sensors 71, 72 are of a transmission type and respectively include light emitting portions 71*a*, 72*a* and light receiving portions 71*b*, 72*b* configured to receive light emitted from the respective light emitting portions 71*a*, 72*a*. The sensors 71, 72 are disposed at the respective locations at which the sensors 71, 72 are opposed to the belt member 57. The light emitting portion 71*a* of the sensor 71 is fixed to an upstream-side end surface of the platen 61 while the light emitting portion 72*a* of the sensor 72 is fixed to a downstream-side end surface of the platen 61. The light receiving portion 71*b* of the sensor 71 is fixed to the horizontal portion 66*b* of the connecting member 66 while the light receiving portion 72*b* of the sensor 72 is fixed to the horizontal portion 67*b* of the connecting member 67.

In the arrangement described above, the sensors 71, 72 are configured to detect the sheet P that is conveyed by the belt conveyor device 50 when the light which is emitted from the light emitting portions 71*a*, 72*a* and travels toward the light receiving portions 71*b*, 72*b* through the light transmitting region (the belt member 57) is interrupted by the sheet P. Since the sensors 71, 72 are disposed at the respective locations at which the sensors 71, 72 are opposed to the light transmitting region (the belt member 57), the sensors 71 72 can detect the sheet P with high reliability despite the transmission type sensors. The light transmitting region (in the form of the belt member 57) is formed on the conveyor surface 54, so that the sensors 71, 72 can detect the sheet P without a fear of causing the sensors 71, 72, especially, the light emitting portions 71*a*, 72*a*, to be stained with the ink or the like.

As shown in FIG. 2, a pressing roller 48 is disposed on the upstream side of one of the four ink-jet heads 2 that is located on the most upstream side in the sheet conveyance direction A, so as to be opposed to the belt roller 51 with the conveyor belt 53 interposed therebetween. The pressing roller 48 is biased toward the conveyor surface 54 by an elastic member such as a spring and is configured to press the sheet P supplied from the sheet supply device 10 onto the conveyor surface 54. The pressing roller 48 is a driven roller configured to be rotated in accordance with the rotary movement of the conveyor belt 53.

In this structure, the conveyance motor 59 is driven under the control of the controller 100, whereby the belt roller 52 is rotated clockwise (in a forward direction) or counterclockwise (in a reverse direction), as seen in FIG. 3A. In accordance with the rotation of the belt roller 52, the conveyor belt 53 and the belt roller 51 which is a driven roller are rotated. When the belt roller 52 is rotated clockwise in FIG. 2 and the fan 62 is driven by the controller 100, the air is sucked in through the through-holes 53*a* of the conveyor belt 53 which are opposed to the through-holes 61*a* of the platen 61, so that the sheet P supplied from the sheet supply device 10 is conveyed in the sheet conveyance direction A while adhering to the conveyor surface 54. Further, when the sheet P conveyed by and held on the conveyor surface 54 of the conveyor belt 53 passes right under the four ink-jet heads 2, the ink-jet heads 2 controlled by the controller 100 eject the respective inks toward the sheet P, so that an intended color image is formed on the sheet P.

As shown in FIG. 2, a separation plate 9 is disposed on the immediately downstream side of the belt conveyor device 50 in the sheet conveyance direction A. The separation plate 9 is configured to separate the sheet P from the conveyor surface 54 such that the edge of the separation plate 9 is inserted between the sheet P and the conveyor belt 53.

At a portion of the sheet transfer path between the belt conveyor device 50 and the discharged-sheet receiving portion 15, there are disposed: four feed rollers 21*a*, 21*b*, 22*a*, 22*b*; and a sheet guide 18 disposed between the feed rollers 21*a*, 21*b* and the feed rollers 22*a*, 22*b*. The feed rollers 21*b*, 22*b* are rotatably driven by feed motors 23, 24 (FIG. 5) controlled by the controller 100. When the feed motors 23, 24 are driven under the control of the controller 100 so as to rotate the feed rollers 21*b*, 22*b*, the sheet P discharged from the conveyor device 50 is transferred upward in FIG. 2 while being held by the rollers 21*a*, 21*b* and guided by the sheet guide 18. Subsequently, the sheet P is transferred to the discharged-sheet receiving portion 15 while being held by the feed rollers 22*a*, 22*b*. The feed rollers 21*a*, 22*a* are driven rollers configured to be rotated as the sheet is transferred.

A buzzer 6 is disposed in the casing 1*a*, as shown in FIG. 2. The buzzer 6 is configured to generate a sound under the control of the controller 100 when a jam of the sheet P (so-called paper jam) has occurred between the ejection surfaces 2*a* and the belt conveyor device 50 and when the sensor 71 detects an unremoved jammed sheet P which has not been removed by the user. The sound of the buzzer 6 informs the user of the fact that the sheet P is being jammed between the ejection surfaces 2*a* and the belt conveyor device 50 and the fact that the unremoved jammed sheet P remains between the ejection surfaces 2*a* and the belt conveyor device 50.

Figure 4A:
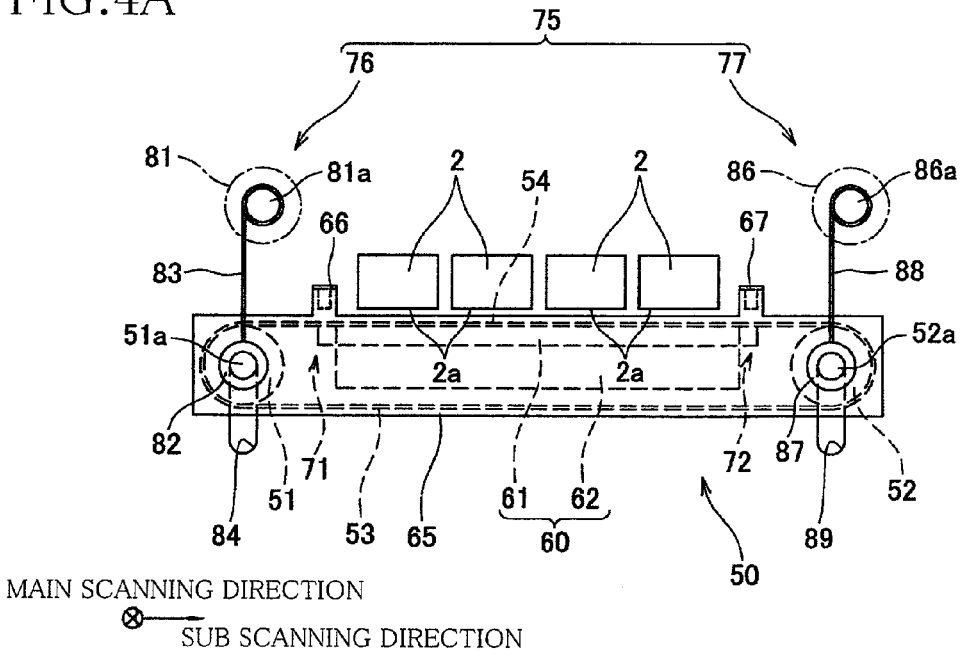
FIGS. 4A and 4B are views showing an up/down moving mechanism configured to move the belt conveyor device upward and downward, FIG. 4A showing a state in which the belt conveyor device is located at a recording position and FIG. 4B showing a state in which the belt conveyor device is located at the sheet removal position.
Figure 4B:
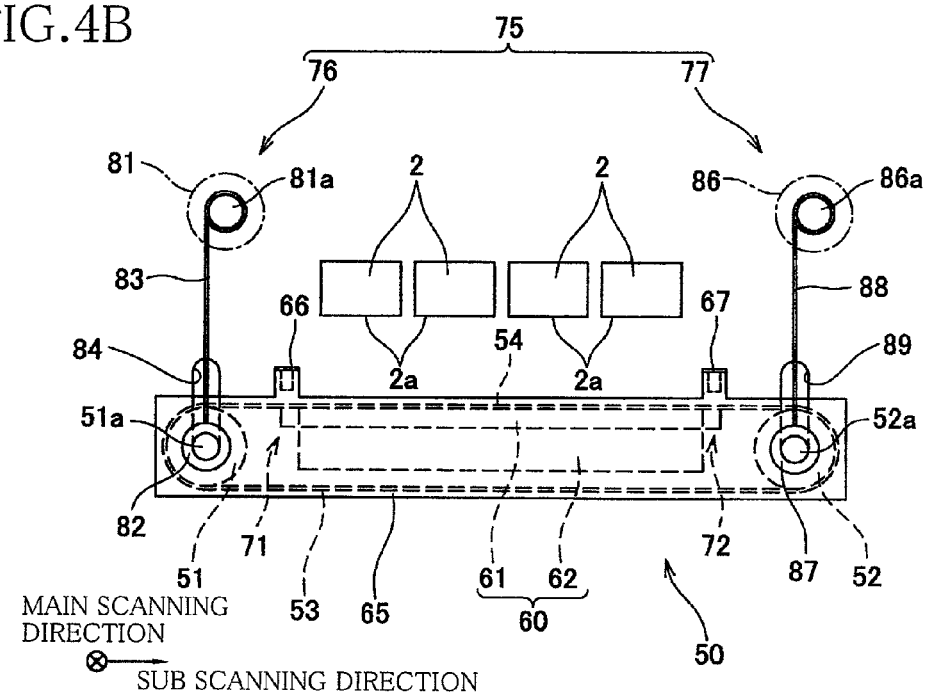

Referring next to FIGS. 4A and 4B, there will be explained an up/down moving mechanism 75 as a relative movement mechanism configured to move the belt conveyor device 50 upward and downward. The up/down moving mechanism 75 has an up/down moving portion 76 for moving the belt roller 51 upward and downward and an up/down moving portion 77 for moving the belt roller 52 upward and downward.

The up/down moving portion 76 has an up/down motor 81, two rings 82, wires 83 each as a connecting member, and guides 84. The rings 82 are disposed near respective opposite axial ends of a roller shaft 51*a* of the belt roller 51 and rotatably support the roller shaft 51*a*. At respective positions of the casing 1*a* facing the opposite axial ends of the roller shaft 51*a* of the belt roller 51, the guides 84 are formed in which the opposite axial ends of the roller shaft 51*a* are movably disposed. Each guide 84 is formed such that its upper end coincides with the position of the roller shaft 51*a* at a time when the belt conveyor device 50 is located at a recording position (FIG. 4A) at which an image is recorded or printed on the sheet P with the ink ejected from the ink-jet heads 2. The guide 84 extends downward from its upper end. Each wire 83 is fixed at one end thereof to an upper end of the corresponding ring 83 and is fixed to and wound around a motor shaft 81*a* of the up/down motor 81 at the other end thereof.

Similarly, the up/down moving portion 77 has an up/down motor 86, two rings 87, wires 88, and guides 89. The rings 87 are disposed near respective opposite axial ends of the roller shaft 52*a* of the belt roller 52 and rotatably support the roller shaft 52*a*. At respective positions of the casing 1*a* facing the opposite axial ends of the roller shaft 52*a* of the belt roller 52, the guides 89 are formed in which the opposite axial ends of the roller shaft 52*a* are movably disposed. Each guide 89 is formed such that its upper end coincides with the position of the roller shaft 52*a* at a time when the belt conveyor device 50 is located at the recording position. The guide 89 extends downward from its upper end. Each wire 88 is fixed at one end thereof to an upper end of the corresponding ring 87 and is fixed to and wound around a motor shaft 86*a* of the up/down motor 86 at the other end thereof.

In the structure described above, when the two up/down motors 81, 86 are simultaneously driven under the control of the controller 100 and the motor shafts 81*a*, 86*a* are rotated counterclockwise in FIG. 4A, the wires 83, 88 are unwound from the respective motor shafts 81*a*, 86*a*, whereby the belt conveyor device 50 moves downward along the guides 84, 89, as shown in FIG. 4B. That is, the belt conveyor device 50 is moved from the recording position to a sheet removal position as a medium removal position at which a distance between the ejection surfaces 2*a* and the belt conveyor device 50 in the vertical direction is larger than that when the ink-jet heads 2 and the belt conveyor device 50 are located at the recording position and at which a jammed sheet P jammed between the ejection surfaces 2*a* and the belt conveyor device 50 is allowed to be removed by the user. On the other hand, when the motor shafts 81*a*, 86*a* are rotated clockwise in FIG. 4B under the control of the controller 100, the wires 83, 88 are wound around the respective motor shafts 81*a*, 86*a*, whereby the belt conveyor device 50 moves upward along the guides 91, 92. That is, the belt conveyor device 50 is moved from the sheet removal position to the recording position.

Next, the controller 100 will be explained. The controller 100 accommodates hardware such as a CPU, a ROM, and a RAM. The ROM stores various software including programs for controlling the operations of the printer 1. Various portions 101-105 (FIG. 5) that will be explained are constituted by combining the hardware and the software. The two sensors 71, 72 are connected to the controller 100. When each sensor 71, 72 detects the sheet P, a detection signal thereof is sent to the controller 100. The sensor 5 is also connected to the controller 100. When the door 4 is placed into the closed state from the open state, the sensor 5 sends a detection signal to the controller 100.

Figure 5:
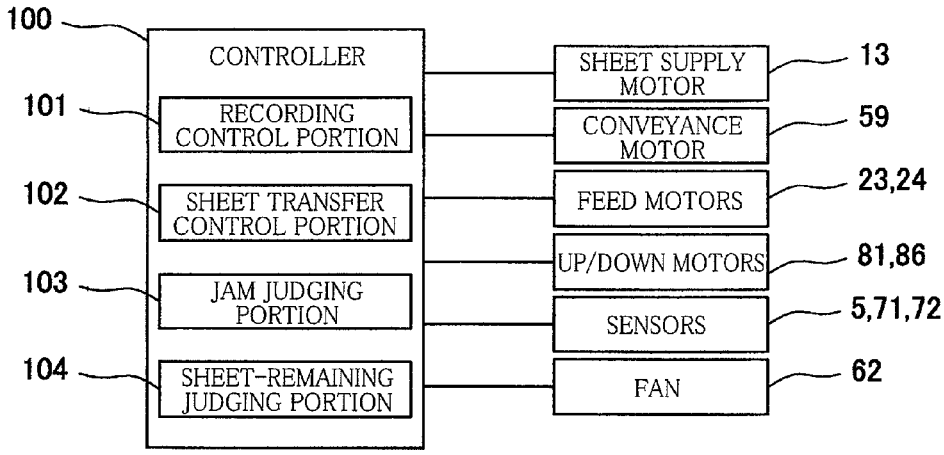
FIG. 5 is a block diagram schematically showing a controller shown in FIG. 2.

As shown in the block diagram of FIG. 5, the controller 100 includes a recording control portion 101, sheet-transfer control portion 102, a jam judging portion 103, and a sheet-remaining judging portion 104.

The recording control portion 101 is configured to control ink ejection from each ink-jet head 2 such that the ink is ejected to the sheet P based on record or print data transmitted from a host computer (not shown) to the controller 100. In this instance, the recording control portion 101 controls each ink-jet head 2 to start ink ejection toward the sheet P a predetermined time after the sensor 71 has detected the leading end of the sheet P conveyed by the belt conveyor device 50. The arrangement permits the ink to be ejected from each ink-jet head 2 toward the sheet P in the recording or printing operation, on the basis of the timing of detection of the sheet P by the sensor 71. Accordingly, the sensor 71 performs two functions, i.e., a function of detecting the ink ejection timing and a function of detecting a jam of the sheet as explained below, resulting in a reduction of the number of required components of the ink-jet printer 1. The above-indicated predetermined time is equal to a time obtained by dividing a distance, along the sheet transfer path, between the position of the leading end of the sheet P when the sensor 71 detects the leading end and the position of the ejection holes (not shown) which are located most upstream in the most upstream one of the four ink-jet heads 2, by a speed at which the sheet P is transferred.

The sheet-transfer control portion 102 is configured to control the sheet supply motor 13, the conveyance motor 59, the feed motors 23, 24, and the fan 62 such that the sheet P is transferred from the sheet supply device 10 to the discharged-sheet receiving portion 15 when the record data is transmitted to the controller 100.

The jam judging portion 103 is configured to judge that a jam of the sheet P has occurred only when a time interval of detection of the leading end of the sheet P by the two sensors 71, 72 exceeds a prescribed time. Here, the prescribed time is equal to a time obtained by dividing the distance between the two sensors 71, 72 along the sheet transfer or conveyance path by the sheet transfer or conveyance speed. Further, the jam judging portion 103 is configured to control the record control portion 101 and the sheet-transfer control portion 102 to stop the ink ejection from each ink-jet head 2, to stop transfer or conveyance of the sheet P, and to stop driving the fan 62, in an instance where the jam judging portion 103 judges that the jam of the sheet P has occurred. Moreover, in an instance where the jam judging portion 103 judges that the jam of the sheet P has occurred, the jam judging portion 103 controls the buzzer 6 to generate a sound so as to notify the user of the occurrence of the jam of the sheet P between the ejection surfaces 2*a* and the belt conveyor device 50. In addition, the jam judging portion 103 controls the up/down moving mechanism 75 to conduct a first operation in which the belt conveyor device 50 is moved from the recording portions to the sheet removal position, in an instance where the jam judging portion 103 judges that the jam of the sheet P has occurred. Accordingly, the user is allowed to carry out a sheet removal operation for removing the jammed sheet P which is being jammed between the ejection surfaces 2*a* and the belt conveyor device 50, by opening the door 4.

In this respect, where the time interval of detection of the leading end of the sheet P by the two sensors 71, 82 is held within the prescribed time and accordingly the jam judging portion 103 does not judge the occurrence of the paper jam, the inks are ejected to the sheet P in a state in which the ink-jet heads 2 are opposed to the sheet P, whereby an image is formed on the sheet P. It is noted that the jam judging portion 103 and the sensors 71, 72 cooperate with each other to constitute a detecting device configured to detect the occurrence of the jam of the sheet P between the ejection surfaces 2*a* and the belt conveyor device 50.

The sheet-remaining judging portion 140 is configured to control the belt conveyor device 50 to conduct a second operation in which an unremoved jammed sheet P which is still being jammed between the ejection surfaces 2*a* and the belt conveyor device 50 without having been removed is conveyed in a direction opposite to the sheet conveyance direction A, when the sensor 5 detects the closed state of the door 4 in response to the user's operation to close the door 4 after completion of the sheet removal operation. The detection of the closed state of the door 4 by the sensor 5 is identical with the output of a jam-clearing completion signal indicative of completion of a jam-clearing processing after the user has carried out the sheet removal operation. Hence the sensor 5 and the door 4 cooperate with each other to constitute an output device. According to the arrangement, the jam-clearing completion signal is automatically outputted when the user closes the door 4 after the user has removed the jammed sheet P, for instance. Accordingly, the arrangement does not need any additional operation by the user for outputting the jam-clearing completion signal other than the operation to close the door 4 by the user.

Further, the sheet-remaining judging portion 104 controls, in the second operation, the fan 62 to be driven so as to cause the unremoved jammed sheet P to adhere to the conveyor surface 54. According to the arrangement, the unremoved jammed sheet P adheres to the conveyor surface 54, whereby the unremoved jammed sheet P can be moved, with high reliability, to a location at which the unremoved jammed sheet P is opposed to the sensor 71 and the unremoved jammed sheet P does not float or separate away from the conveyor surface 54. Therefore, the unremoved jammed sheet P can be detected by the sensor 71 with high reliability. Further, the sheet-remaining judging portion 104 controls, in the second operation, the belt conveyor device 50 such that the unremoved jammed sheet P is conveyed by a distance not greater than a distance between the two belt rollers 51, 52. The arrangement prevents the unremoved jammed sheet P from being conveyed by a distance more than needed, thereby reducing a time during which the second operation is conducted. Consequently, the arrangement can reduce a total time required for the overall operation including the first, the second, and a third operation that will be explained below. Further, the sheet-remaining judging portion 104 controls, in the second operation, the belt conveyor device 50 to stop conveyance of the unremoved jammed sheet P when the sensor 71 detects the unremoved jammed sheet P. The arrangement prevents the unremoved jammed sheet P from getting into much worse state. Further, the sheet-remaining judging portion 104 controls, in the second operation, the buzzer 6 to generate a sound when the sensor 71 detects the unremoved jammed sheet P. The arrangement can notify the user that the unremoved jammed sheet P remains between the ejection surfaces 2*a* and the belt conveyor device 50.

Further, the sheet-remaining judging portion 104 controls, after the second operation, the up/down moving mechanism 75 to conduct the third operation in which the belt conveyor device 50 is moved from the sheet removal position to the recording position. More specifically, the sheet-remaining judging portion 104 controls the up/down moving mechanism 75 to conduct the third operation where the sensor 71 does not detect the unremoved jammed sheet P in the second operation.

Further, the sheet-remaining judging portion 104 again controls, at a time point after the second operation and before the third operation, the buzzer 6 to generate a sound when the sensor 5 detects the closed state of the door 4 after completion of the sheet removal operation by the user and the sensor 71 detects the unremoved jammed sheet P. The arrangement can again notify the user that the unremoved jammed sheet P still remains between the ejection surfaces 2*a* and the belt conveyor device 50.

Further, the sheet-remaining judging portion 104 controls, at a time point after the second operation and before the third operation, the belt conveyor device 50 to conduct a fourth operation similar to the second operation, when the sensor 5 detects the closed state of the door 4 after completion of the sheet removal operation by the user and the sensor 71 does not detect the unremoved jammed sheet P. According to the arrangement, it is possible to again detect whether the unremoved jammed sheet P still remains between the ejection surfaces 2*a* and the belt conveyor device 50. That is, where the unremoved jammed sheet P has been detected in the second operation, the sheet removal operation is carried out. When the jam-clearing completion signal that indicates completion of the sheet removal operation is outputted, the fourth operation is conducted even if the unremoved jammed sheet P is not being detected the sensor 71. Where the unremoved jammed sheet P is not detected in the fourth operation, the third operation is conducted.

Referring next to FIGS. 6A-6D, the jam-clearing processing which is conducted to clear the jam of the paper P will be explained.

Figure 6A:
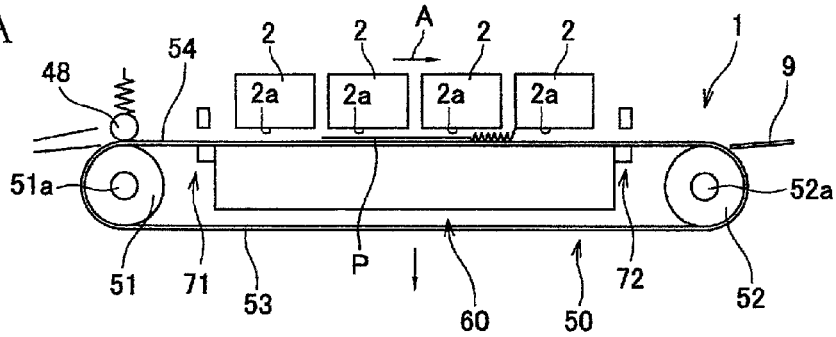
FIGS. 6A-6D are side views showing an operation status of the belt conveyor device in a jam-clearing processing.

When a jam of the sheet P occurs between the ejection surfaces 2*a* and the belt conveyor device 50 shown in FIG. 6A during conveyance of the sheet P by the belt conveyor device 50 in the sheet conveyance direction A, the controller 100 controls the ink-jet heads 2 to stop the ink ejection therefrom, controls the fan 62 to stop operating, controls the belt conveyor device 50 to stop conveyance of the sheet P, and controls the up/down moving mechanism 75 to conduct the first operation. As a result, there is formed a large space between the ejection surfaces 2*a* and the belt conveyor device 50 shown in FIG. 6B, permitting the user to easily remove the jammed sheet P. Subsequently the controller 100 controls the buzzer 6 to generate a sound. Thus, the user is notified that the sheet P is jammed between the ejection surfaces 2*a* and the belt conveyor device 50 and is encouraged to carry out the sheet removal operation.

Figure 6B:
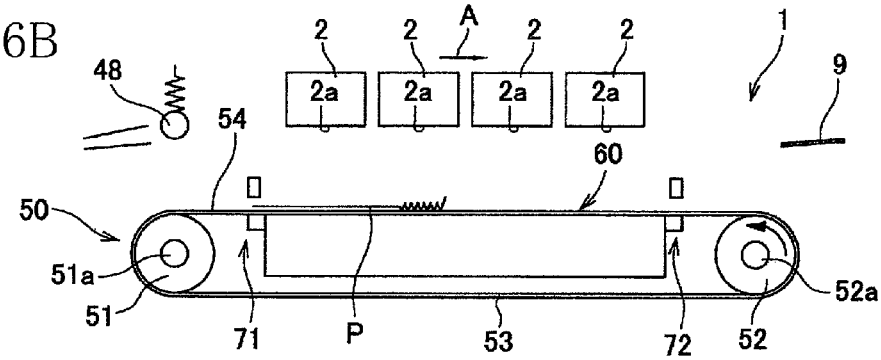

Subsequently, after the user carries out the sheet removal operation and the door 4 is closed, the controller 100 controls the belt conveyor device 50 to conduct the second operation, as shown in FIG. 6B. According to the arrangement, in an instance where the jammed sheet P still remains on the conveyor surface 54 due to a user's failure to remove it, for instance, the unremoved jammed sheet P can be detected by the sensor 71 when the unremoved jammed sheet P is conveyed to and reaches at a prescribed position where the unremoved jammed sheet is opposed to the sensor 71. In general, the jam of the paper P that is conveyed in the sheet conveyance direction A is caused due to a contact of the leading end of the sheet P and the ejection surface 2*a* of each ink-jet head 2 or the upstream-side surface of each ink-jet head 2, as shown in FIG. 6A. In this case, the jammed sheet P is crumpled or bent at a part thereof extending from the leading end to the middle. In view of this, the jammed sheet P is conveyed in the direction opposite to the sheet conveyance direction A in the second operation, whereby the sensor can detect the jammed sheet P at a part thereof near to its trailing end which is kept rather straight and flat without being crumpled. Accordingly, it is possible to increase the detection accuracy of the sensor with which the jammed sheet P is detected.

In the second operation, the controller 100 controls the fan 62 to be placed in its operating state for causing the unremoved jammed sheet to adhere to the conveyor surface 54 and controls the belt conveyor device 50 to convey the unremoved jammed sheet P by a distance not greater than the distance between the two belt rollers 51, 52 and to stop the unremoved jammed sheet P from being conveyed when the sensor 71 detects the unremoved jammed sheet P. Where the unremoved jammed sheet P is not detected by the sensor 71 in the second operation, the controller 100 judges that the unremoved jammed sheet P has been completely removed by the user's sheet removal operation and controls the up/down mechanism 75 to conduct the third operation. Thus, the jam-clearing processing is completed.

On the other hand, where the unremoved jammed sheet P has been detected by the sensor 71 in the second operation, the controller 100 controls the buzzer 6 to generate a sound. Thus, the user is notified that the unremoved jammed sheet P still exists between the ejection surfaces 2*a* and the belt conveyor device 50 and is again encouraged to carry out the sheet removal operation.

After having been again encouraged to carry out the sheet removal operation as described above, in an instance where the user merely closes the door 4 without carrying out the sheet removal operation due to some reason, the sensor 71 keeps detecting the unremoved jammed sheet P. In this instance, the controller 100 again controls the buzzer 6 to generate a sound. Thus, the user is again notified that the unremoved jammed sheet P still exists between the ejection surfaces 2*a* and the belt conveyor device 50 and is encouraged to carry out the sheet removal operation.

Figure 6C:
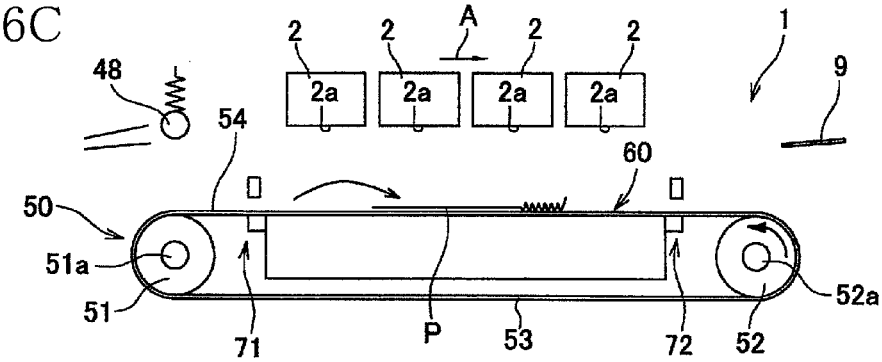

After having been encouraged to carry out the sheet removal operation as described above, in an instance where the user closes the door 4 in a state in which the unremoved jammed sheet P is not being detected by the sensor 71 because the user has moved the unremoved jammed sheet P toward the downstream side in the sheet conveyance direction A as shown in FIG. 6C, the controller 100 controls the belt conveyor device 50 to conduct the fourth operation. That is, in an instance where the user closes the door 4 even though the unremoved jammed sheet P still exists without being detected by the sensor 71, the fourth operation is conducted, whereby it is possible to again detect whether the unremoved jammed sheet P exists between the ejection surfaces 2*a* and the belt conveyor device 50. Further, the controller 100 controls the buzzer 6 to generate a sound, so as to encourage the user to carry out the sheet removal operation. The detection of the unremoved jammed sheet P by the sensor 71 is conducted every time when the door 4 is closed. In the detection, where the sensor 71 has detected the unremoved jammed sheet P, the buzzer generates a sound. In the detection, where the sensor 71 does not detect the unremoved jammed sheet P, the fourth operation is conduced, so that the unremoved jammed sheet P can be detected by the sensor 71.

Figure 6D:
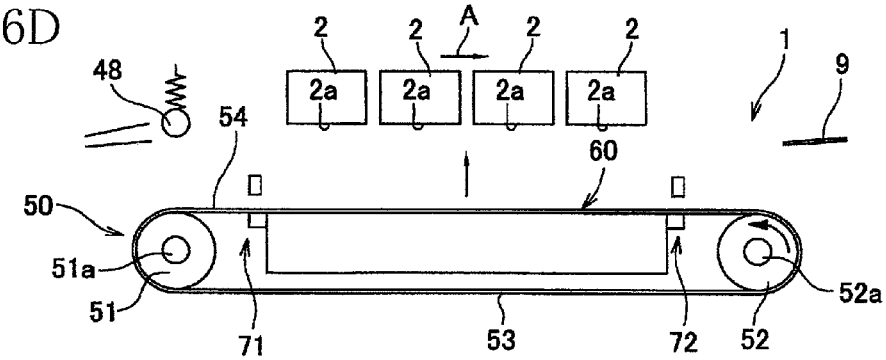

After having been encouraged to carry out the sheet removal operation as described above, in an instance where the unremoved jammed sheet is completely removed as shown in FIG. 6D by the user in the sheet removal operation, the door 4 is closed, and the sensor 71 does not detect the unremoved jammed sheet P any more in the fourth operation, the controller 100 judges that the unremoved jammed sheet P has been completely removed by the user's sheet removal operation and controls the up/down moving mechanism 75 to conduct the third operation. Thus, the jam-clearing processing is completed.

In the ink-jet printer 1 constructed as described above, even where the jammed sheet still remains, after the first operation, between the ejection surfaces 2*a* and the belt conveyor device 50 due to some reason such as the user's failure to remove the jammed sheet P, the unremoved jammed sheet P can be detected in the second operation. According to the arrangement, there is no fear of remaining the sheet P between the ejection surfaces 2*a* and the belt conveyor device 50 when the third operation is conducted, so that the ejection surfaces 2*a* can be protected from being damaged by contacting the unremoved jammed sheet P in the third operation.

While the sensors 71, 72 used in the present embodiment are of a transmission type, the sensors 71, 72 may be of a reflection type configured to detect the sheet P by sensing a light reflected on the surface of the sheet P. Where the reflection-type sensors are employed, these sensors may be disposed at respective locations at which the light receiving portions 71*b*, 72*b* of the transmission-type sensors 71, 72 are respectively positioned. That is, the reflection-type sensors are fixed to the horizontal portions 66*b*, 67*b* of the respective connecting members 66, 67. In this case, it is not required to employ the transmission-type sensors 71, 72 having the light emitting portions 71*a*, 72*a* and the light receiving portions 72*a*, 72*b*. Further, the reflection-type sensors can detect the sheet P with high reliability without forming, in the conveyor belt 53, the light transmitting region given by the belt member 57. Since the reflection-type sensors are fixed to the connecting members 66, 67 that are fixed to the support frames 65 of the belt conveyor device 50, the reflection-type sensors are moved together with the belt conveyor device 50. Accordingly, the focal points of the sensors are prevented from deviating from the unremoved jammed sheet P on the conveyor belt 54, so that the unremoved jammed sheet can be detected by the reflection sensors with high reliability.

In the present embodiment, the jam-clearing completion signal is automatically outputted when the door 4 is closed. Alternatively, a switch 201 may be provided on the upper surface of the casing 1*a* as shown in the two-dot chain line in FIG. 1. When the switch 201 is pressed, the jam-clearing completion signal indicative of completion of the jam-clearing processing is outputted to the controller 100. If such a switch 201 is employed, the jam-clearing completion signal is outputted when the user presses the switch 201. In this instance, the sensor 5 and the projection 4*a* need not be provided.

While the presently preferred embodiment has been described, it is noted that the invention is not limited to the details of the illustrated embodiment, but may be embodied with various changes and modifications, which may occur to those skilled in the art, without departing from the spirit and scope of the invention defined in the attached claims.

The up/down moving mechanism 75 in the present embodiment is configured to move only the belt conveyor device 50. The up/down moving mechanism 75 may be configured to move only the four ink-jet heads 2. In this case, the ink-jet heads 2 are moved from the recording position shown in FIG. 2 to the sheet removal position at which there is formed a space large enough to permit the user to remove the sheet P jammed between the ejection surfaces 2*a* and the belt conveyor device 50, thereby enabling the user to remove the jammed sheet P. The up/down moving mechanism 75 may be configured to move both of the belt conveyor device 50 and the ink-jet heads 2.

The controller 100 may be configured to move, in the second operation and in the fourth operation, the unremoved jammed sheet P in the sheet conveyance direction A. In this case, the sensor 72 may be configured to detect the unremoved jammed sheet P, in place of the sensor 71. The sensor for detecting the unremoved jammed sheet P may be disposed between any adjacent two of the four ink-jet heads 2. In this case, the controller may be configured to control the belt conveyor device such that the unremoved jammed sheet P is initially conveyed, in the second and the fourth operations, in a first direction toward the upstream side or the downstream side. On this occasion, the unremoved jammed sheet P may be conveyed by a distance between the most upstream head and the most downstream head. If the unremoved jammed sheet P is not detected during conveyance thereof in the first direction described above, the sheet P is subsequently conveyed in a second direction opposite to the first direction. On this occasion, the unremoved jammed sheet P may be conveyed by the distance between the most upstream head and the most downstream head. According to the arrangement, the sensor can detect the unremoved jammed sheet P if present between the ejection surfaces 2*a* and the belt conveyor device 50. The controller 100 may be configured to control the belt conveyor device 50 to convey, in the second and the fourth operations, the unremoved jammed sheet P by a distance larger than the distance between the two belt rollers 51, 52.

In place of the buzzer 6, there may be provided, on the upper surface of the casing 1*a*, a display that indicates an image which notifies the user of occurrence of the jam of the sheet P and presence of the unremoved jammed sheet P. The notifying device such as the buzzer 6 may be eliminated.

The controller 100 may be configured not to conduct the fourth operation. The sensor 71 may be configured not to detect the sheet P for obtaining the timing of ink ejection in printing an image on the sheet P. In this case, the controller 100 may be configured to control each ink-jet head 2 to start ejecting the ink to the sheet P after a lapse of a time period from a time point at which the sheet supply device 10 supplies the sheet P to a time point at which the leading end of the sheet P reaches a position where the leading end of the sheet P is opposed to the most upstream ink-jet head 2. Where the sensors 71, 72 are of the transmission type, the sensors 71, 72 may not be fixed to the belt conveyor device 50. That is, the sensors 71, 72 may not be moved together with the belt conveyor device 50.

The adhesion device 60 configured to be placed in its operating state so as to cause the sheet P to adhere to the conveyor surface 54 may be eliminated. In this case, the conveyor surface 54 preferably has low adhesion property. Further, the adhesion device may be an electrostatic adhesion device configured to pass a direct current so as to generate static electricity in the platen. In these arrangements, it is not needed to form through-holes 53*a* in the conveyor belt 53, simplifying the structure of the belt conveyor device.

In the illustrated embodiment, the belt conveyor device 50 is employed as a conveyor device for conveying the sheet P so as to be opposed to the ejection surfaces 2*a*. Such a conveyor device may be a roller conveyor device including: two roller pairs configured to rotate with the sheet P held by the rollers of each pair so as to convey the sheet P in the sheet conveyance direction; and a platen disposed between the two roller pairs. In this case, the sensors 71, 72 are preferably disposed such that one of the sensors 71, 72 is located between one of the two roller pairs and one of the two outermost ink-jet heads 2 in the sheet conveyance direction and such that the other of the sensors 71, 72 is located between the other of the two roller pairs and the other of the two outermost ink-jet heads 2 in the sheet conveyance direction A. The arrangement enjoys an effect similar to that obtained when the belt conveyor device 50 is employed.

The conveyor surface 54 of the conveyor belt 53 has the light transmitting region provided by the intermediate conveyor belt 57. In place of the light transmitting region, the conveyor surface 54 may have through-holes formed so as to be opposed to the sensors 71, 72.

What is claimed is:

1. An ink jet recording apparatus, comprising:

an inkjet head in which is formed an ejection surface from which ink is ejected;

a conveyor mechanism which is configured to convey a recording medium on a conveyor surface in a medium conveyance direction, so as to be opposed to the ejection surface;

a sensor configured to detect, at a prescribed position, the recording medium being conveyed in the medium conveyance direction on the conveyor surface by the conveyor mechanism;

a relative movement mechanism configured to move at least one of the conveyor mechanism and the ink-jet head relative to each other such that the conveyor mechanism and the ink jet head are located selectively at one of: a recording position at which an image is recorded on the recording medium with the ink ejected from the ink jet head; and a medium removal position at which a distance between the ejection surface and the conveyor mechanism is larger than that when the conveyor mechanism and the ink jet head are located at the recording position and at which a jammed recording medium which is jammed between the ejection surface and the conveyor mechanism is allowed to be removed;

an output device configured to detect a prescribed operation and to output a jam-clearing completion signal indicative of completion of a jam-clearing processing for clearing the jam of the recording medium; and a controller having a jam judging portion configured to judge an occurrence of a jam of the recording medium between the ejection surface and the conveyor mechanism, the controller being configured:

to control the relative movement mechanism to conduct a first operation in which the at least one of the conveyor mechanism and the ink jet head is moved relative to each other such that the conveyor mechanism and the ink jet head are located at the medium removal position from the recording position, when the judging portion judges the occurrence of the jam of the recording medium;

to control the conveyor mechanism to conduct a second operation which is conducted after the first operation and in which an unremoved jammed recording medium which has not been removed is conveyed in the medium conveyance direction so as to be detectable by the sensor, when the output device outputs the jam-clearing completion signal, the second operation being conducted with the conveyor mechanism and the ink jet head located at the medium removal position without operating the relative movement mechanism; and to control the relative movement mechanism to conduct a third operation in which the at least one of the conveyor mechanism and the ink jet head is moved relative to each other such that the conveyor mechanism and the ink jet head are located at the recording position from the medium removal position after the second operation, when the sensor does not detect the unremoved jammed recording medium in the second operation.

2. The ink jet recording apparatus according to claim 1, wherein the controller is configured to control the conveyor mechanism to stop the unremoved jammed recording medium from being conveyed where the sensor detects the unremoved jammed recording medium in the second operation.

3. The ink jet recording apparatus according to claim 1, further comprising a notifying device configured to notify the user that the jammed recording medium between the ejection surface and the conveyor mechanism has not yet been removed, wherein the controller is configured to control the notifying device to notify a user that the unremoved jammed recording medium still exists between the ejection surface and the conveyor mechanism where the sensor detects the unremoved jammed recording medium in the second operation.

4. The ink jet recording apparatus according to claim 3, wherein the controller is configured to control, at a time point after the second operation and before the third operation, the notifying device to notify the user that the unremoved jammed recording medium still exists between the ejection surface and the conveyor mechanism where the output device outputs the jam-clearing completion signal and the sensor detects the unremoved jammed recording medium.

5. The ink jet recording apparatus according to claim 3, wherein the controller is configured to control, at a time point after the second operation and before the third operation, the conveyor mechanism to conduct a fourth operation in which the unremoved jammed recording medium is conveyed so as to be detectable by the sensor where the output device outputs the jam-clearing completion signal and the sensor does not detect the unremoved jammed recording medium.

6. The ink jet recording apparatus according to claim 3, wherein the controller is configured to control the conveyor mechanism to conduct the fourth operation where the output device again outputs the jam-clearing completion signal after detection of the unremoved jammed recording medium in the second operation.

7. The ink jet recording apparatus according to claim 6, wherein the controller is configured to control the relative movement mechanism to conduct the third operation where the unremoved jammed recording medium is not detected in the fourth operation.

8. The ink jet recording apparatus according to claim 1, wherein the sensor is disposed upstream of the ink jet head in the medium conveyance direction, and wherein the controller is configured to control, in the second operation, the conveyor mechanism to convey the unremoved jammed recording medium in a direction opposite to the medium conveyance direction.

9. The ink jet recording apparatus according to claim 8, wherein the controller is configured to control the ink jet head in recording the image on the recording medium so as to start ejecting the ink to the recording medium a predetermined time after the sensor has detected the recording medium.

10. The ink jet recording apparatus according to claim 1, wherein the sensor is of a transmission type configured to detect the recording medium when a light emitted therefrom is intercepted by the recording medium, wherein the conveyor mechanism has the conveyor surface for supporting the recording medium, and wherein the conveyor surface has at least one of a light transmitting region and through-holes formed so as to be opposed to the sensor.

11. The ink jet recording apparatus according to claim 1, wherein the sensor is of a refection type configured to detect the recording medium when the sensor receives a light emitted therefrom and reflected by the recording medium.

12. The ink jet recording apparatus according to claim 11, wherein the relative movement mechanism is configured to move the conveyor mechanism relative to the ink-jet head, and wherein the sensor is disposed so as to be movable together with the conveyor mechanism.

13. The ink jet recording apparatus according to claim 1, wherein the conveyor mechanism includes an adhesion device configured to cause the recording medium to adhere to the conveyor surface, and wherein the controller is configured to control, in the second operation, the adhesion device to be placed in its operating state.

14. The ink jet recording apparatus according to claim 1, further comprising a casing for accommodating the ink jet head, the conveyor mechanism, the sensor, the relative movement mechanism, the output device, and the controller, wherein the casing is provided with a door disposed at a position where the jammed recording medium which is jammed between the ejection surface and the conveyor mechanism is exposable to an exterior of the casing when the door is opened, and wherein the output device is configured to output the jam-clearing completion signal when the door is placed in its closed state from its open state after judgment of the occurrence of the jam by the jam judging portion.

15. The ink jet recording apparatus according to claim 1, wherein the output device is configured to detect manipulation of a switch and to output the jam-clearing completion signal.

16. The ink jet recording apparatus according to claim 1, wherein the conveyor mechanism comprises two rollers arranged in the medium conveyance direction and a conveyor belt stretched between the two rollers and having the conveyor surface on which the recording medium is conveyed, and wherein the controller is configured to control, in the second operation, the conveyor mechanism such that the unremoved jammed recording medium is conveyed by a distance not greater than a distance between the two rollers.

17. The ink jet recording apparatus according to claim 1, further comprising a notifying device configured to notify a user of the occurrence of the jam of the recording medium between the ejection surface and the conveyor mechanism, wherein the controller is configured to control the notifying device to notify the user of the occurrence of the jam of the recording medium after the first operation and before the second operation.

18. The ink jet recording apparatus according to claim 1, wherein the medium conveyance direction is parallel to the ejection surface.

19. An ink jet recording apparatus, comprising:

an inkjet head in which is formed an ejection surface from which ink is ejected;

a conveyor mechanism which is configured to convey a recording medium in a medium conveyance direction parallel to the ejection surface, so as to be opposed to the ejection surface;

a sensor configured to detect, at a prescribed position, the recording medium being conveyed in the medium conveyance direction by the conveyor mechanism;

a relative movement mechanism configured to move at least one of the conveyor mechanism and the ink-jet head relative to each other such that the conveyor mechanism and the ink jet head are located selectively at one of: a recording position at which an image is recorded on the recording medium with the ink ejected from the ink jet head; and a medium removal position at which a distance between the ejection surface and the conveyor mechanism is larger than that when the conveyor mechanism and the ink jet head are located at the recording position and at which a jammed recording medium which is jammed between the ejection surface and the conveyor mechanism is allowed to be removed;

an output device configured to detect a prescribed operation and to output a jam-clearing completion signal indicative of completion of a jam-clearing processing for clearing the jam of the recording medium; and a controller having a jam judging portion configured to judge an occurrence of a jam of the recording medium between the ejection surface and the conveyor mechanism, the controller being configured:

to control the relative movement mechanism to conduct a first operation in which the at least one of the conveyor mechanism and the ink jet head is moved relative to each other such that the conveyor mechanism and the ink jet head are located at the medium removal position from the recording position, when the judging portion judges the occurrence of the jam of the recording medium;

to control the conveyor mechanism to conduct a second operation which is conducted after the first operation and in which an unremoved jammed recording medium which has not been removed is conveyed in the medium conveyance direction so as to be detectable by the sensor, when the output device outputs the jam-clearing completion signal, the second operation being conducted with the conveyor mechanism and the ink jet head located at the medium removal position without operating the relative movement mechanism; and to control the relative movement mechanism to conduct a third operation in which the at least one of the conveyor mechanism and the ink jet head is moved relative to each other such that the conveyor mechanism and the ink jet head are located at the recording position from the medium removal position after the second operation, when the sensor does not detect the unremoved jammed recording medium in the second operation.

* * * * *